US009387355B1

(12) United States Patent
Joya

(10) Patent No.: US 9,387,355 B1
(45) Date of Patent: Jul. 12, 2016

(54) EXERCISE MACHINE WITH RESISTIVE ELEMENTS HAVING MULTIPLE PHYSICAL CONFIGURATIONS

(71) Applicant: Pedro Flores Joya, New Milford, CT (US)

(72) Inventor: Pedro Flores Joya, New Milford, CT (US)

( * ) Notice: Subject to any disclaimer, the term of this patent is extended or adjusted under 35 U.S.C. 154(b) by 14 days.

(21) Appl. No.: 14/339,442

(22) Filed: Jul. 23, 2014

(51) Int. Cl.
*A63B 21/055* (2006.01)

(52) U.S. Cl.
CPC ..... *A63B 21/055* (2013.01)

(58) Field of Classification Search
CPC ..... A63B 21/02; A63B 21/04–21/0442; A63B 21/0557; A63B 21/16
See application file for complete search history.

(56) References Cited

U.S. PATENT DOCUMENTS 7,226,402 B1 * 6/2007 Joya ..... A63B 15/00 473/266
7,601,105 B1 10/2009 Gipson, III et al.
2006/0135329 A1 * 6/2006 Owen ..... A63B 21/04 482/123
2007/0083975 A1 * 4/2007 Senegal ..... A63B 21/0552 2/102
2012/0083395 A1 4/2012 Carson

* cited by examiner

*Primary Examiner* — Oren Ginsberg
*Assistant Examiner* — Jennifer M Deichl
(74) *Attorney, Agent, or Firm* — LaMorte & Associates, P.C.

(57) ABSTRACT

A machine that can be selectively configured to exercise most any muscle group. The exercise machine has a large platform that supports both the elements of the exercise machine and the person exercising. A post extends upwardly from the platform. A hub rides along the length of the vertical post. At least one arm extends from the hub. Receptacles are disposed on the platform and the arms. Gimbaled connectors are provided. Each gimbaled connector is capable of being selectively received by any of the receptacles. Each gimbaled connector holds a free moving anchor post. Elastic resistive elements are provided. The first end of any elastic resistive element in use selectively interconnects with the anchor post within any gimbaled connector. The opposite second end of the elastic resistive element is connected to a garment element that is worn by the person exercising.

15 Claims, 7 Drawing Sheets

EXERCISE MACHINE WITH RESISTIVE ELEMENTS HAVING MULTIPLE PHYSICAL CONFIGURATIONS

BACKGROUND OF THE INVENTION

1. Field of the Invention

In general, the present invention relates to exercise machines that provide resistance during exercises. More particularly, the present invention relates to exercise machines that use elastic resistive elements and enable the elastic resistive elements to be attached to the exercise machine throughout a wide variety of attachment points.

2. Prior Art Description

In U.S. Pat. No. 7,226,402, the Applicant discloses an exercise machine designed to exercise the muscle groups in the middle and lower torso. The machine uses resistive elements that are anchored to arms that are supported by a vertical post. Similar exercise machines are disclosed in U.S. Pat. No. 7,601,105 to Gipson and U.S. Patent Application Publication No. 2012/0083395 to Carson. Although all of these prior art machines contain some degree of adjustability, these machines are limited to the performance of only a handful of exercises. Furthermore, although such prior art machines provide resistance through the use of elastic elements, the elastic elements are terminated with handles or poles that must be gripped by a person's hands. As such, a person exercising must grasp a handle or pole in order to obtain resistance.

Many people undergoing rehabilitation and/or specialized training perform exercises that require resistance to unusual movements. For example, a person may need resistance applied to movements of his/her elbow or to movements of his/her lower back. In such instances, exercise machines that require the gripping of a handle cannot be effectively used.

Furthermore, exercises to rehabilitate or train specialized parts of a user's body may require that resistance be applied in an unusual directional vector. In the prior art, the direction of resistance that can be applied by a resistive element exercise machine mainly relies upon the anchor points of the resistive elements. Although these anchor points may be adjustable through small ranges, the anchor points provide significant limitations.

A need therefore exists for an improved exercise machine configuration that utilizes resistive elements, yet has no fixed anchor points for the resistive elements. Rather, the resistive elements attach to articulating anchors that can be selectively attached to the exercise machine at multiple points on the exercise machine. A need also exists for an exercise machine that has resistive elements that can attach to an exercising person at most any point between the head and feet. As such, resistance can be applied to any part of the body in most any direction for rehabilitation and/or specialized training. These needs are met by the present invention as described and claimed below.

SUMMARY OF THE INVENTION

The present invention is an exercise machine that can be selectively configured to exercise most any muscle group in the body. The exercise machine has a large platform that supports both the elements of the exercise machine and the person performing the exercises.

A vertical post extends upwardly from the platform. The vertical post is anchored to the platform for stability. A hub rides along the length of the vertical post, wherein the hub can be selectively locked in place at points along the vertical post.

At least one arm extends from the hub. The arms are connected to the hub at pivot joints that enable the arms to be selectively adjusted in angle relative the hub and vertical post.

A plurality of receptacles are disposed on the platform and the arms. At least one gimbaled connector is provided. Each gimbaled connector is capable of being selectively received by any of the receptacles. Each gimbaled connector holds a free moving anchor post. At least one elastic resistive element is provided. Each elastic resistive element has a first end and an opposite second end. The first end of any elastic resistive element in use selectively interconnects with the anchor post within said gimbaled connector. The opposite second end of the elastic resistive element is connected to a garment element that is worn by the person exercising.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention exercise machine can be embodied in many ways, the illustrations only show a single exemplary embodiment. This exemplary embodiment is selected in order to set forth the best mode contemplated for the invention. The illustrated embodiment, however, is merely exemplary and should not be considered a limitation when interpreting the scope of the appended claims.

Figure 1:
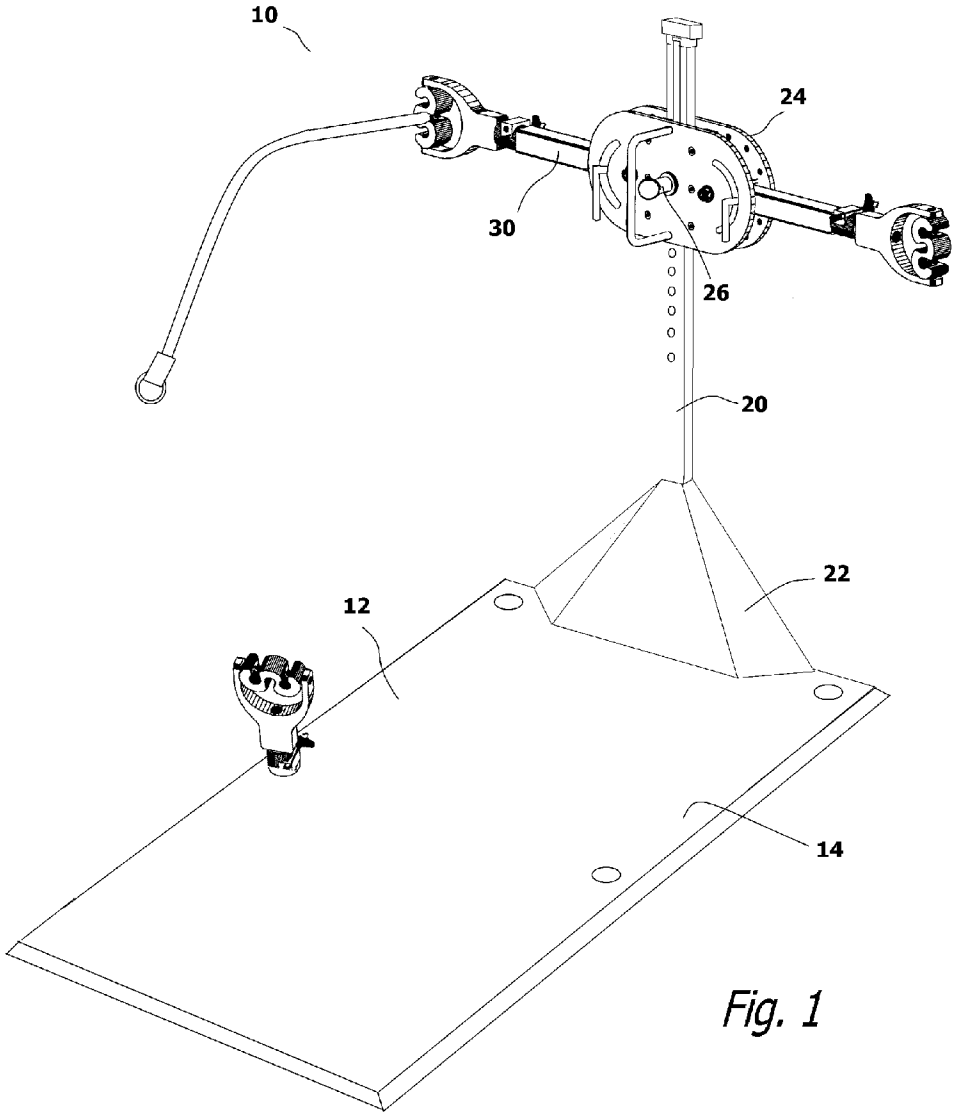
FIG. 1 is a perspective view of an exemplary embodiment of an exercise machine in accordance with the present invention.
Figure 2:
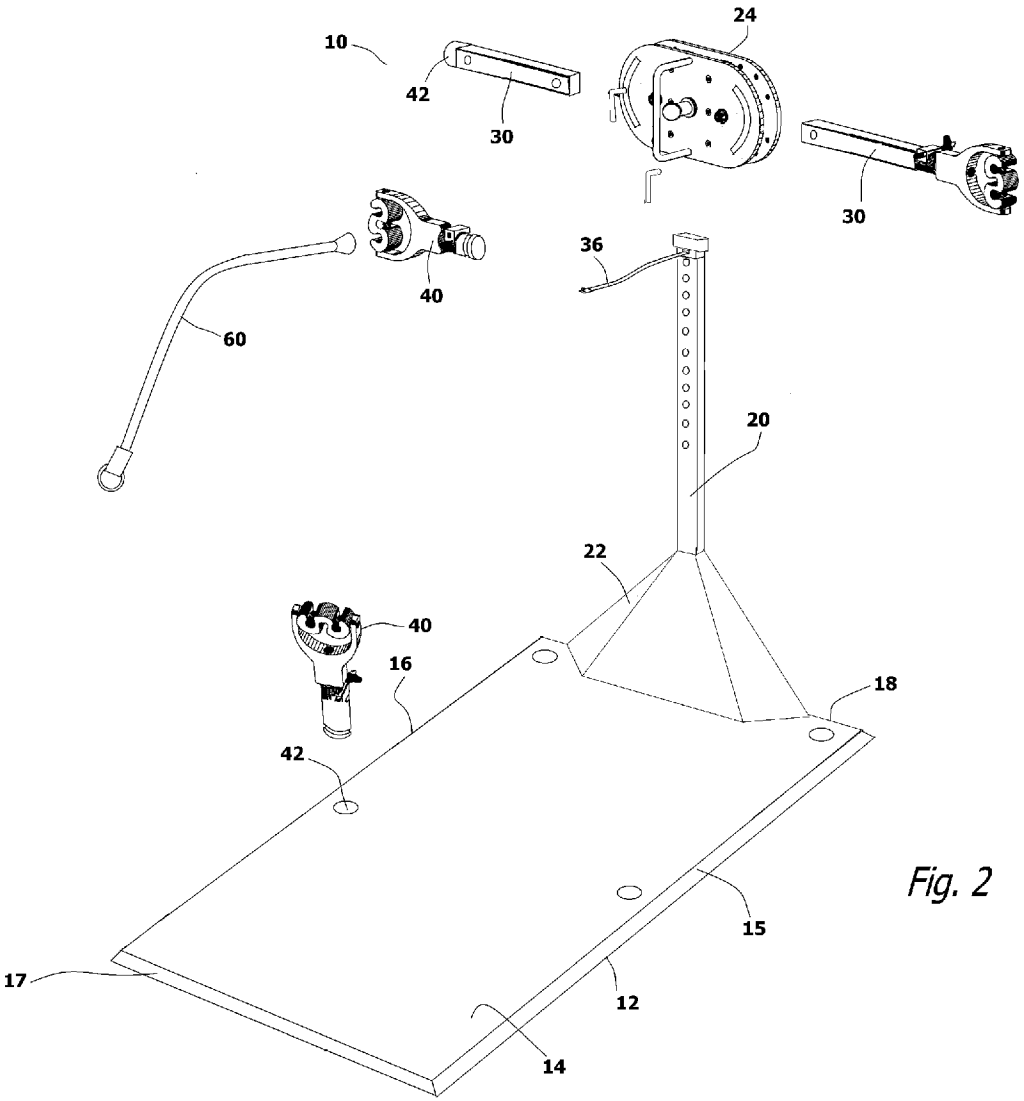
FIG. 2 is an exploded view of the exemplary embodiment of FIG. 1.

Referring to FIG. 1 in conjunction with FIG. 2, an exercise machine 10 is shown. The exercise machine 10 has a platform 12 that lay flat against the floor and provides the overall exercise machine 10 with great stability. A person who uses the exercise machine 10 stands atop the platform 12. As such, the weight of the person exercising helps bias the platform 12 against the ground and makes the overall exercise machine 10 nearly impossible to accidentally topple, regardless of the forces being applied to the exercise machine 10 while a person is exercising.

The platform 12 has a top surface 14 upon which a person stands. The periphery of the platform 12 is defined by two parallel long sides 15, 16 and two parallel short sides 17, 18. A vertical post 20 extends upwardly from the platform 12 in the center of one of the short sides 17, 18. The vertical post 20 is secured by bracketing 22 that rigidly interconnects the vertical post 20 to the platform 12. In this manner, the vertical post 20 and platform 12 are interconnected and are incapable of relative movement.

Figure 3:
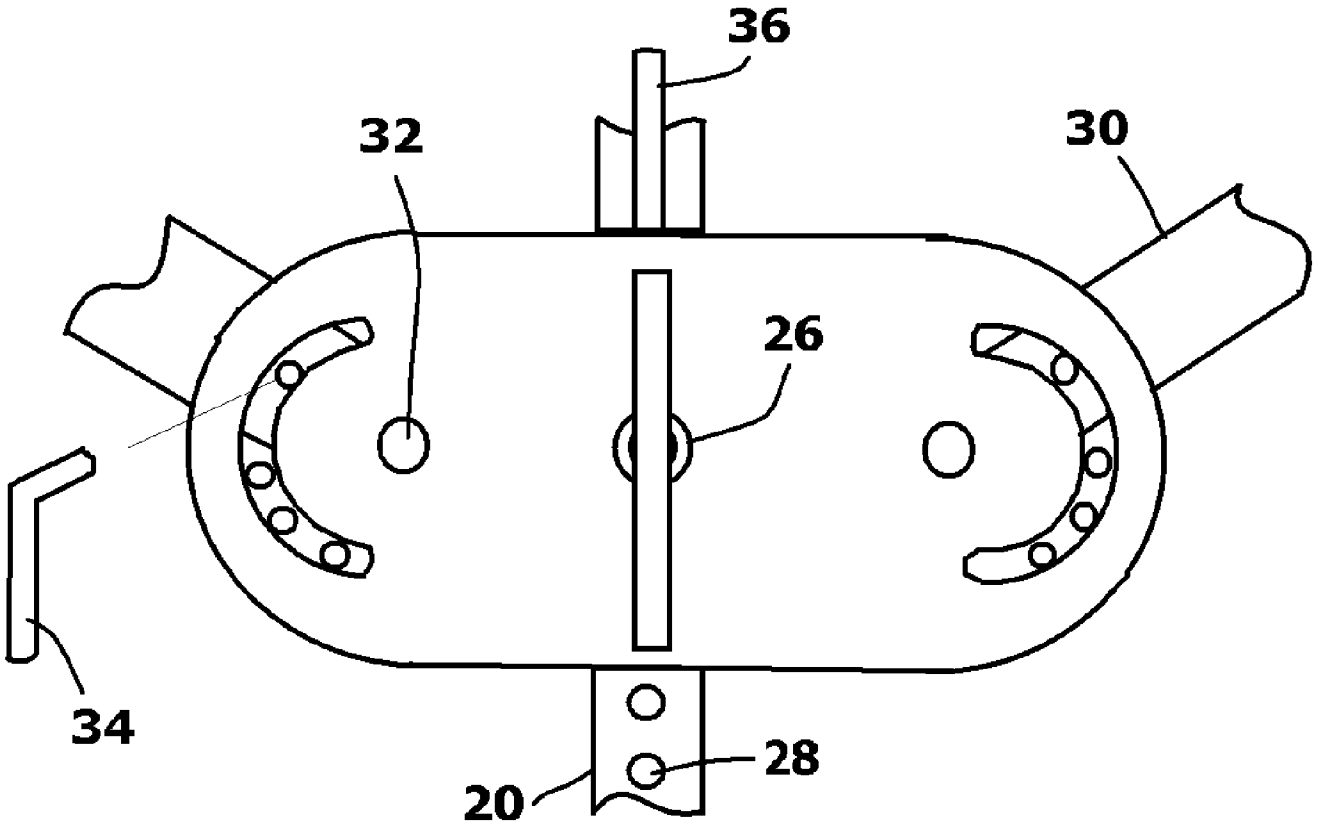
FIG. 3 is an enlarged view of the hub used in the exemplary embodiment of the exercise machine.

A hub 24 is provided. The vertical post 20 passes through the hub 24. This enables the hub 24 to reciprocally move along the length of the vertical post 20. Referring to FIG. 3 in conjunction with FIGS. 1 and 2, it can be seen that a vertical adjustment pin 26 passes through the hub 24. The vertical adjustment pin 26 engages holes formed along the length of the vertical post 20. Using the vertical adjustment pin 26, the hub 24 can be locked in place at several points along the length of the vertical post 20. Once locked in place, the hub 24 is set at a fixed elevation on the vertical post 20 until the vertical adjustment pin 26 is disengaged from the holes 28 in the vertical post 20.

Two arms 30 attach to the hub 24. The arms 30 attach to the hub 24 at two adjustable hinge joints 32. The hinge joints 32 enable the angle of the arms 30 to be adjusted relative to the vertical line of the vertical post 20. At the top most and bottom most adjustment positions, the arms 30 are nearly parallel to the vertical post 20. At the middle adjustment point, the arms 30 are perpendicular to the vertical post 20. The arms 30 can be locked in place at various angles by using arm locking pins 34 that extend through the arms 30 and engage the hub 24.

The arms 30 and hub 24 together can have significant mass. To prevent the hub 24 and arms 30 from sliding down the vertical post 20 the moment the vertical adjustment pin 26 is pulled, a counterbalance system 36 is preferably used. The counterbalance system 36 is a weight system or spring system that is primarily disposed inside the vertical post 20. The counterbalance system 36 provides tension to a cable or ribbon spring that extends down from the top of the vertical post 20 and engages the hub 24. The upward force applied to the hub 24 by the counterbalance system 36 is generally equal to the weight of the hub 24 and arms 30 combined. In this manner, the hub 24 and arms 30 can be moved along the length of the vertical post 20 without a user having to support the full weight of the hub 24 and arms 30.

Returning to FIGS. 1 and 2, it can be seen that one or more gimbaled connectors 40 interconnect with the exercise machine 10. The gimbaled connectors 40 can attach to the exercise machine 10 at a variety of points, therein altering the exercise machine 10 in preparation of different exercises. The gimbaled connectors 40 are assemblies that can be selectively attached to receptacles 42 on the exercise machine 10. A receptacle 42 is located at the end of each of the arms 30. Receptacles 42 are also located on the platform 12 at various points near the periphery of the platform 12.

Figure 4:
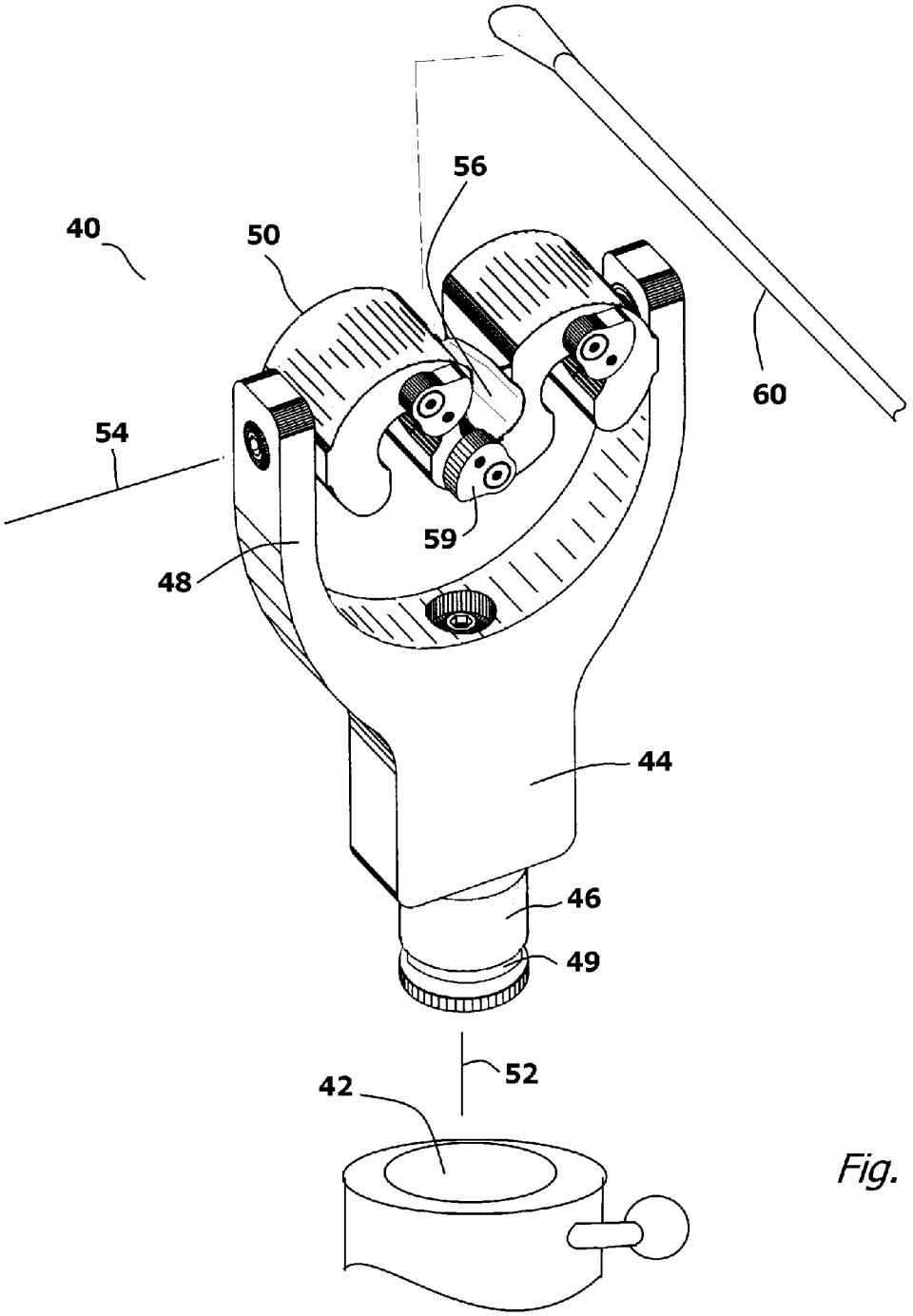
FIG. 4 is an enlarged view of a gimbaled connector used in the exemplary embodiment of the exercise machine.
Figure 5:
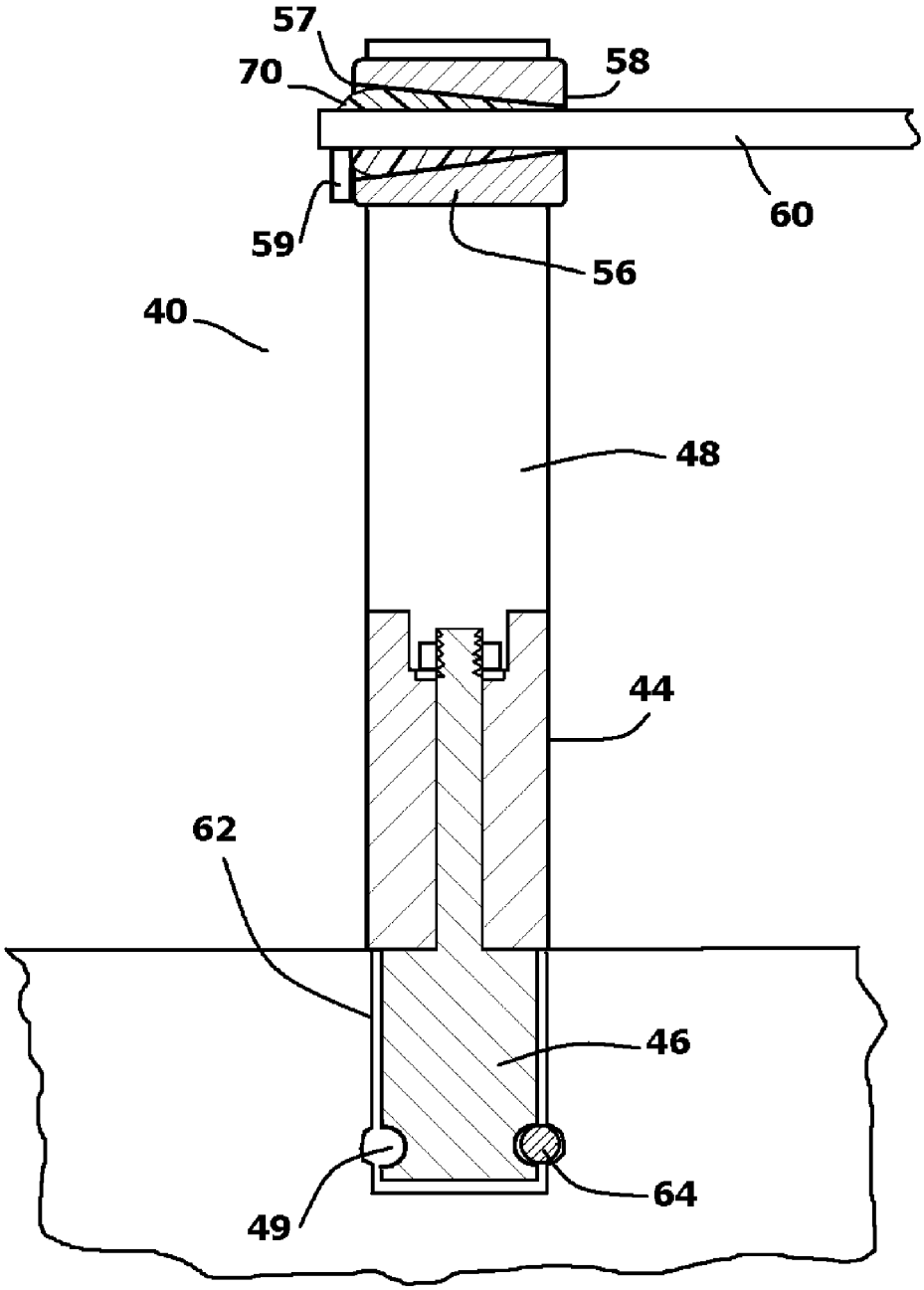
FIG. 5 is a cross-sectional view of the gimbaled connection shown in FIG. 4.

Referring to FIG. 4 and FIG. 5, it can be seen that each gimbaled connector 40 has a Y-shaped body 44. The Y-shaped body 44 has a neck 46 at one end and a yoke 48 at the opposite end. The neck 46 of the Y-shaped body 44 terminates above a groove 49. The neck 46 is symmetrically formed around a first imaginary axis 52. An anchor post 50 extends across the yoke 48. The anchor post 50 extends along a second imaginary axis 54 that is perpendicular to the first imaginary axis 52. The anchor post 50 is free to rotate about the second imaginary axis 54, while engaged within the yoke 48. As such, it will be understood that the anchor post 50 can spin about the second imaginary axis 54 while the Y-shaped body 44 rotates about the first imaginary axis 52.

The anchor post 50 is designed to selectively engage elastic resistive elements 60. Within the anchor post 50 are a plurality of tapered slots 56. The tapered slots 56 have wide ends 57 and narrow ends 58. Spring loaded fingers 59 are attached to the anchor post 50 at points adjacent each of the wide ends 57 of the tapered slots 56. The purpose of the tapered slots 56 and the fingers 59 are later explained.

Each of the receptacles 42 contains a tubular opening 62 that can receive the groove 49 on the neck 46 of a gimbaled connector 40. Once received within the tubular opening 62, the groove 49 is engaged with a locking pin 64. Once engaged with the locking pin 64, the gimbaled connector 40 is mechanically interlocked with a receptacle 42 and cannot be pulled away. To remove a gimbaled connector 40 from a receptacle 42, the locking pin 64 is manually displaced.

Figure 6:
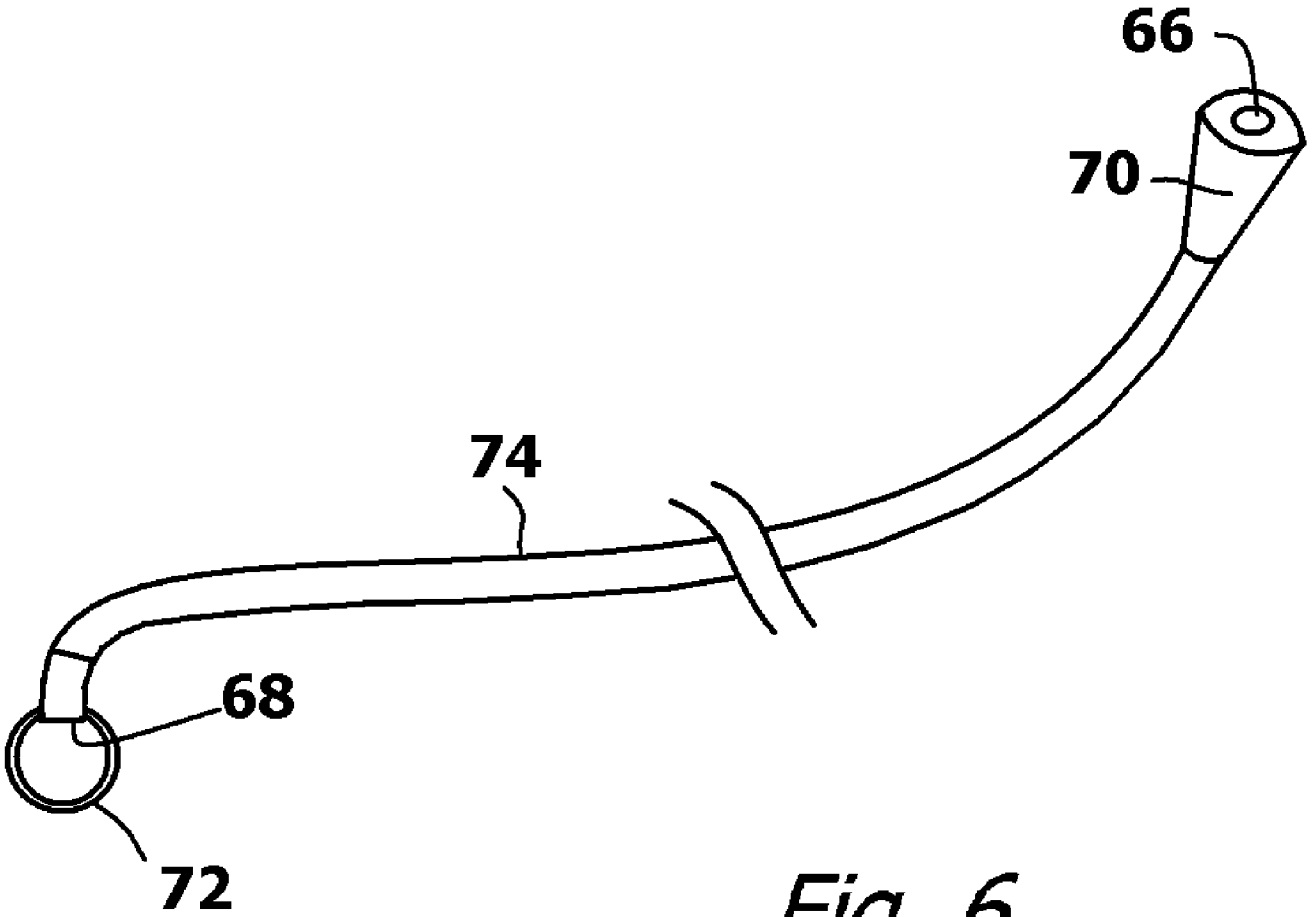
FIG. 6 is an enlarged view of an elastic resistive element used in the exemplary embodiment of the exercise machine.

Referring to FIG. 6 in conjunction with the previous figures, it can be seen that each of the elastic resistive elements 60 has a first end 66 and a second end 68. The first end 66 is terminated with an enlarged stop 70. The second end 68 is terminated with a clip ring 72. Each elastic resistive element 60 is fabricated from a tube 74 of elastomeric material. Inside the tube 74 is elastic cordage. The elastic cordage limits the elongation of the resistive element 60. This prevents the tube 74 from being accidentally overstretched and damaged.

The enlarged stop 70 at the first end 66 of each elastic resistive element 60 is larger than the narrow end 58 of a tapered slot 56 in an anchor post 50. Yet, the enlarged stop 70 is smaller than the wide end 57 of a tapered slot 56. This enables the enlarged stop 70 to pass into a tapered slot 56 and get wedged in place within the tapered slot 56. Once wedged within a tapered slot 56, the locking fingers 59 can be moved across the wide end 57 of the tapered slot 56 to prevent the enlarged stop 70 from exiting. Once the enlarged stop 70 is wedged and locked into a tapered slot 56, the elastic resistive element 60 is mechanically interlocked with the gimbaled connector 40.

The elastic resistive element 60 is attached to the gimbaled connector 40. More specifically, the elastic resistive element 60 attaches to the anchor post 50 of the gimbaled connector 40. As such, the anchor post 50 and the neck 46 of the gimbaled connector 40 rotate as tension forces are applied to the elastic resistive element 60 in changing directional vectors.

The second end 68 of the elastic resistive element 60 terminates with a clip ring 72. The clip ring 72 can be engaged by any element manually moved by the person exercising. The clip ring 72 can attach to a handle. However, for many of the preferred exercises, the clip ring 72 attaches to a specialty garment.

Figure 7:
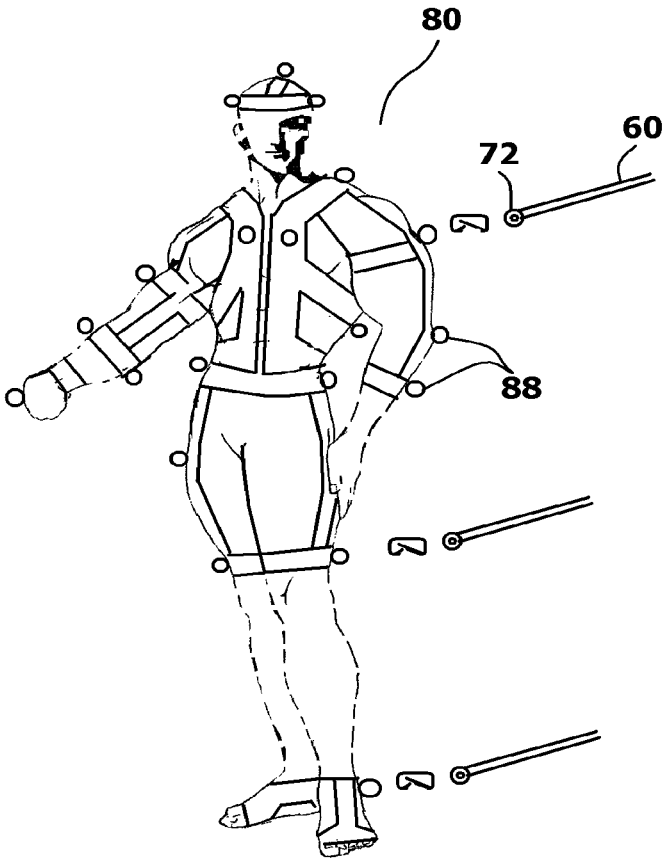
FIG. 7 shows a garment set for use with the exercise machine.

Referring to FIG. 7, a full garment set 80 is shown. The garment set includes an upper torso harness 81, a lower torso harness 82, a belt 83, hand harnesses 84, feet harnesses 85, and a head harness 86. Each element in the garment set 80 contains clip rings 88 at various points. Referring to FIG. 7 in conjunction with the earlier figures, it will be understood that the various elastic resistive elements 60 can be attached to the various elements of the garment set 80 by interconnecting the clip rings 72, 88. The clip rings 72, 88 are interconnected using carabineers or similar mechanical connectors 90.

Referring to all figures, it will be understood that in order to utilize the present invention, a person attaches one or more elements of the garment set 80 to his/her body. The user then attaches one or more gimbaled joint connectors 40 to the exercise machine 10. If a gimbaled connector 40 is attached to the arms 30 of the exercise machine 10, then the arms 30 can be adjusted to selected heights and angles. Elastic resistive elements 60 are then attached to the gimbaled connectors 40. The second ends 68 of the elastic resistive elements 60 are then attached to the garment elements being worn to provide resistance to movement.

Since the elastic resistive elements 60 can be attached to multiple points on a user's body from multiple points on the exercise machine 10, it will be understood that the exercise machine 10 can be configured to train most of the muscle groups in the body. Furthermore, trainers are provided with the ability to design specific exercises for rehabilitation and/or specialized training.

It will be understood that the embodiment of the present invention that is illustrated and described is merely exemplary and that a person skilled in the art can make many variations to that embodiment. All such embodiments are intended to be included within the scope of the present invention as defined by the claims.

What is claimed is:

1. An exercise machine, comprising:

a platform;

a vertical post extending upwardly from said platform, wherein said vertical post is anchored to said platform;

a hub that moves along said vertical post;

at least one arm that extends from said hub;

a plurality of receptacles disposed on said platform and said at least one arm;

a gimbaled connector that includes a Y-shaped body having a neck at one end and a yoke at an opposite end, wherein said neck of said Y-shaped body can be received by any of said plurality of receptacles, wherein said gimbaled connector supports an anchor post therein that extends across said yoke within said gimbaled connector, wherein said anchor post is free to rotate within said yoke;

an elastic resistive element having a first end and a second end, wherein said first end of said elastic resistive element selectively interconnects with said anchor post within said gimbaled connector.

2. The machine according to claim 1, wherein said first end of said elastic resistive element interconnects with said anchor post.

3. The machine according to claim 1, wherein said anchor post defines a tapered slot, and wherein said first end of said elastic resistive element is received by said tapered slot.

4. The machine according to claim 3, wherein said first end of said elastic resistive element terminates with an enlarged stop and said enlarged stop wedges within said tapered slot.

5. The machine according to claim 1, further including a locking mechanism for selectively locking said hub into fixed positions along said vertical post.

6. The machine according to claim 1, wherein said at least one arm is selectively adjustable in orientation relative said hub.

7. The machine according to claim 1, wherein said at least one arm is configured as two arms, wherein both of said two arms connect to said hub.

8. The machine according to claim 1, further including a garment element, wherein said second end of said elastic resistive element connects to said garment element.

9. An exercise machine, comprising:

a vertical post;

arms that are supported at an elevation by said vertical post;

a plurality of receptacles, wherein at least one of said plurality of receptacles is disposed on each of said arms;

a gimbaled connector that includes a Y-shaped body having a neck at one end and a yoke at an opposite end, wherein said neck of said Y-shaped body can be received by any of said plurality of receptacles, wherein said gimbaled connector supports an anchor post therein;

an anchor post that extends across said yoke within said gimbaled connector, wherein said anchor post is free to rotate about said yoke;

an elastic resistive element having a first end and a second end, wherein said first end of said elastic resistive element selectively interconnects with said anchor post within said gimbaled connector.

10. The machine according to claim 9, further including a platform that supports said vertical post, wherein at least some of said plurality of receptacles are disposed on said platform.

11. The machine according to claim 10, further including a hub that moves along said vertical post, wherein said arms are pivotably connected to said hub.

12. The machine according to claim 9, wherein said first end of said elastic resistive element interconnects with said anchor post.

13. The machine according to claim 9, wherein said anchor post defines a tapered slot, wherein said first end of said elastic resistive element is received by said tapered slot.

14. The machine according to claim 9, wherein said arms are selectively adjustable in orientation relative said vertical post.

15. The machine according to claim 9, further including a garment element, wherein said second end of said elastic resistive element connects to said garment element.

* * * * *